US005295476A

United States Patent [19]

Herbert

[11] Patent Number: 5,295,476

[45] Date of Patent: Mar. 22, 1994

[54] GAS HOB

[75] Inventor: Eric D. Herbert, Cheshire, Great Britain

[73] Assignee: Blue Circle Domestic Appliances Limited, Warwickshire, United Kingdom

[21] Appl. No.: 768,851

[22] PCT Filed: Apr. 4, 1990

[86] PCT No.: PCT/GB90/00503

§ 371 Date: Oct. 8, 1991

§ 102(e) Date: Oct. 8, 1991

[87] PCT Pub. No.: WO90/12255

PCT Pub. Date: Oct. 18, 1990

[30] Foreign Application Priority Data

Apr. 8, 1989 [GB] United Kingdom ..... 8907946
Sep. 6, 1989 [GB] United Kingdom ..... 8920153

[51] Int. Cl.[5] ..... F24C 3/00

[52] U.S. Cl. ..... 126/39 G; 126/39 J; 126/39 K; 126/39 R

[58] Field of Search ..... 129/39 G, 39 J, 39 K, 129/39 R

[56] References Cited

U.S. PATENT DOCUMENTS 2,870,829 1/1959 Williams ..... 126/39 J
3,606,612 9/1971 Reid ..... 126/39 J
3,785,364 1/1974 Reid, Jr. et al. .
3,843,313 10/1974 Helgeson .
3,968,785 7/1976 Perl .

FOREIGN PATENT DOCUMENTS 1535931 12/1978 United Kingdom .

*Primary Examiner*—Carroll B. Dority
*Attorney, Agent, or Firm*—Keck, Mahin & Cate

[57] ABSTRACT

A gas hob has a glass ceramic top plate and gas fired heat radiating burner units below the top plate. Each burner unit has a lower plate which includes a number of concentric chambers. A ceramic burner plate is disposed over the lower plate. The burner plate is perforated to match the arrangement of concentric chambers to provide concentric gas burning rings. The supply of gas to the burner units is controllable by respective control valves enabling gas to be supplied only to the burner plate perforation at which supply of heat is required. A fan below the level of the burner units supplies air to a plenum chamber which communicates with ducts leading to the concentric chambers. The fan supplies combustion air at all times when a burner unit is in operation. Gas from the control valve mixes in the ducts with air from the plenum chamber before entering one of the concentric chambers and the gas burning ring.

15 Claims, 3 Drawing Sheets

GAS HOB

Figure 1:
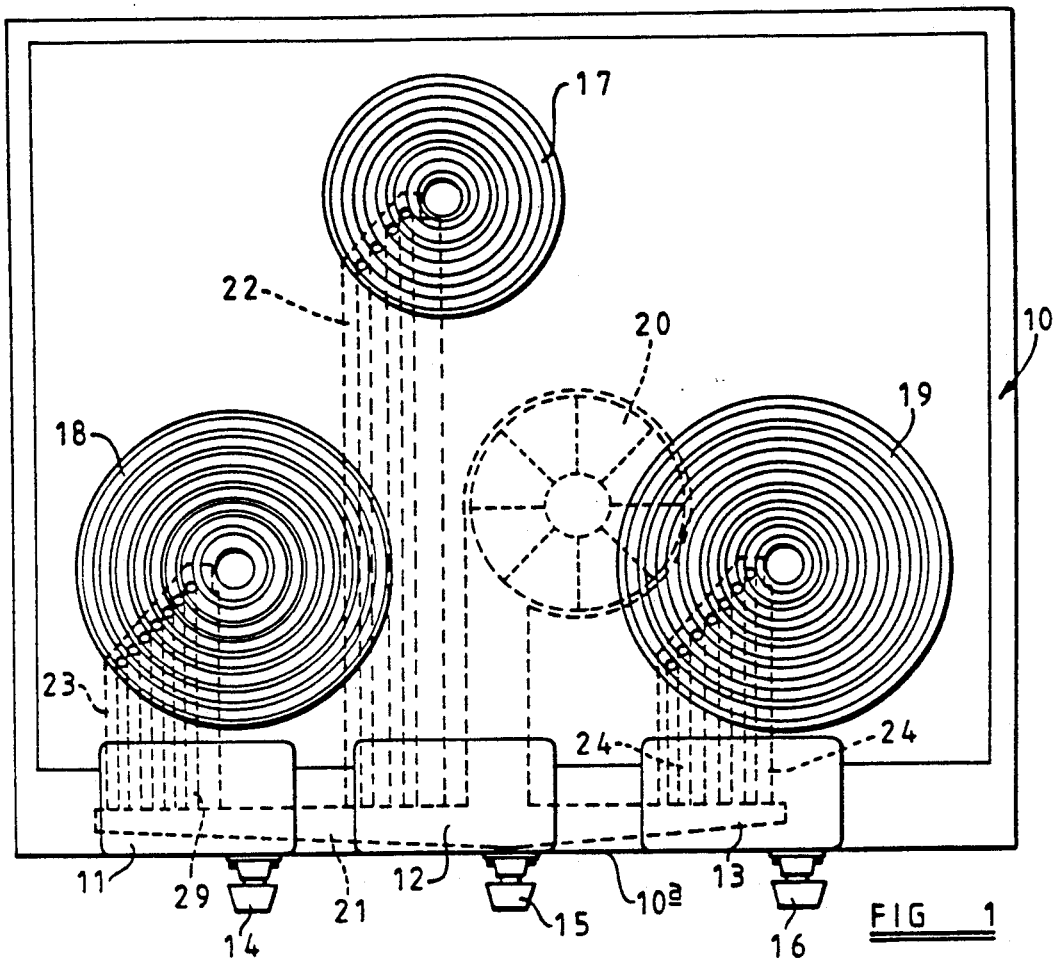

This invention relates to a gas hob. An appliance with such a hob is used for delivering heat to the base of cooking utensils and is known variously as a "hob unit", "boiling top", "hot plate", or "boiling table", being used either domestically or in commercial catering food preparation.

Recent developments of electrically heated hob units have led to the extensive use of ceramic glass cover plates, of a type known as "Ceran", a Trade Mark of SCHOTT GLASSWERKE, OF MAINZ, WEST GERMANY, over the various types of heating elements in use and with the heat being transferred to the pan through the glass by radiation and also by conduction from the glass directly to the base of the pan.

Attempts to utilize gas heating for similar ceramic glass top hobs have been less successful because whilst the advantages of easy cleaning etc, as for instance described in U.K. patent no. 1,419,499, can be achieved, the speed of heating, ease of control and thermal efficiency, when compared to an open flame gas burner used in a traditional type gas hob, are quite inferior.

It has been shown when utilizing tests commonly used to compare gas hobs, as for instance detailed in British Standard 5386 part 3, that thermal efficiencies of only 32% can be obtained with ceramic glass tops, compared to open flame cookers which easily exceed 50%. Similarly when heating speeds were compared, although the ceramic glass gas heated top achieved roughly similar times to electrically heated hobs, it was at best 25% slower than would be accepted for a conventional gas heated hob.

One of the most important functional aspects of a gas hob is its ability to be adjusted quickly and easily to vary the heat input to a wide range of cooking requirements, and this has in the past been seen as a significant advantage for the open flame hob over all others. The amount of heat being supplied can be easily judged by the appearance of the flames.

It is widely known that radiant heating burners will not operate well at gas inputs much less than their optimum, due to flame instability. A minimum heat input no less than 60% of the maximum is the least that can commonly be achieved. It is also widely known that the radiant output of such burners reduces rapidly when their gas input and operating temperature is reduced only slightly. This is due to the reduction in primary aeration when gas pressure is reduced and has led to such partial solutions as multiple injector jets (British patent application GB 2201 506A).

Because of these factors, and because a cooker hob burner must have a very wide range of outputs so that small pans can also be controlled at a low temperature, it has been common practise to use a pulsed on/off system whereby the ratio of burner time on (at full rate) to burner time off sets the heat input.

Since cooker hob burners are usually adjusted to below their maximum heat outputs for most cooking demands, it follows that they are nearly always operating at a much reduced efficiency and that the lower they are set, the lower the efficiency becomes.

When comparing the controllability of various types of hob units, it is found that the ability rapidly to 'lose' heat input to the pan is quite as important as the ability to increase heat input quickly. In this respect, since the ceramic glass hob has considerable thermal mass when particularly compared with open flame burners, it is at some disadvantage, although the performance is similar to electronic heated ceramic hobs, which in turn have somewhat poorer performance than conventional tubular element electric heated hobs.

The amount of heat that is transmitted from one body to another is greatly affected by the distance between them. However, with gas burners in closed hobs this minimum is set by the space above the burner necessary for the gaseous products of combustion to escape and also for any secondary combustion air to reach the burner flames. This factor also limits the maximum area burner which can be used.

An object of the present invention is to provide a gas hob burner system which overcomes or at least significantly reduces these problems and enables a gas heated hob to compete much more effectively with the traditional open flame burner type and still to maintain the good appearance, ease of cleaning and other advantages of the electric heated glass ceramic hob.

According to the present invention a gas hob comprises a glass ceramic top plate, at least one gas fired heat radiating burner unit arranged closely below said top plate, the or each burner unit having a multiplicity of chambers over which is disposed a ceramic burner plate perforated to match the pattern of said chambers, gas supply means, fan means for supplying combustion air at all times when the or each burner unit is in operation, supplied gas and combustion air mixing prior to entering one or more of said chambers and thereafter one or more of said burner plate perforations, and means for supplying gas only to the or each burner plate perforation at which supply of heat is required.

Figure 2:
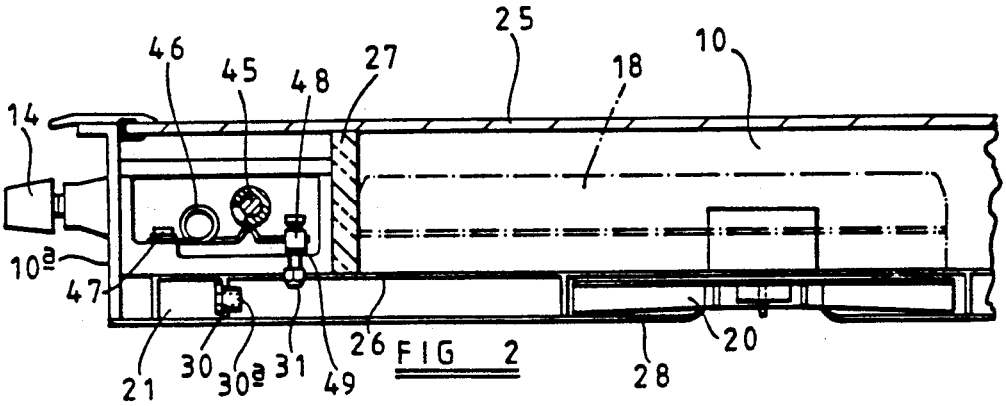
Figure 3:
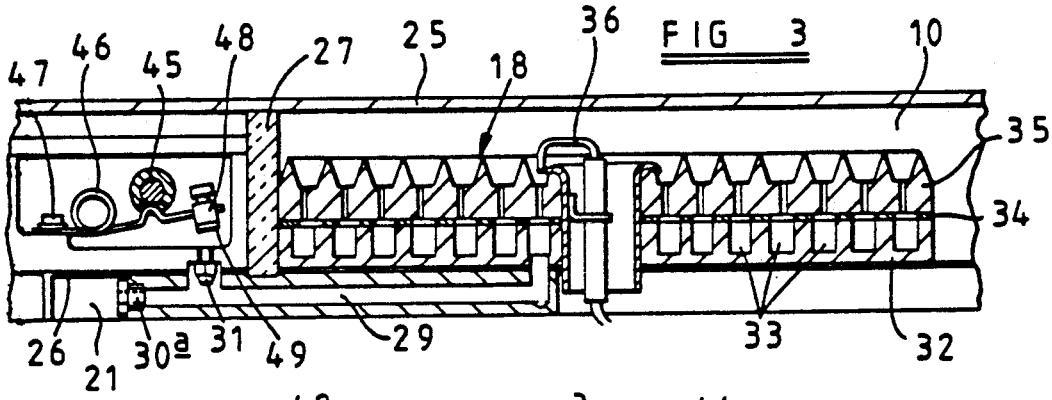
Figure 4:
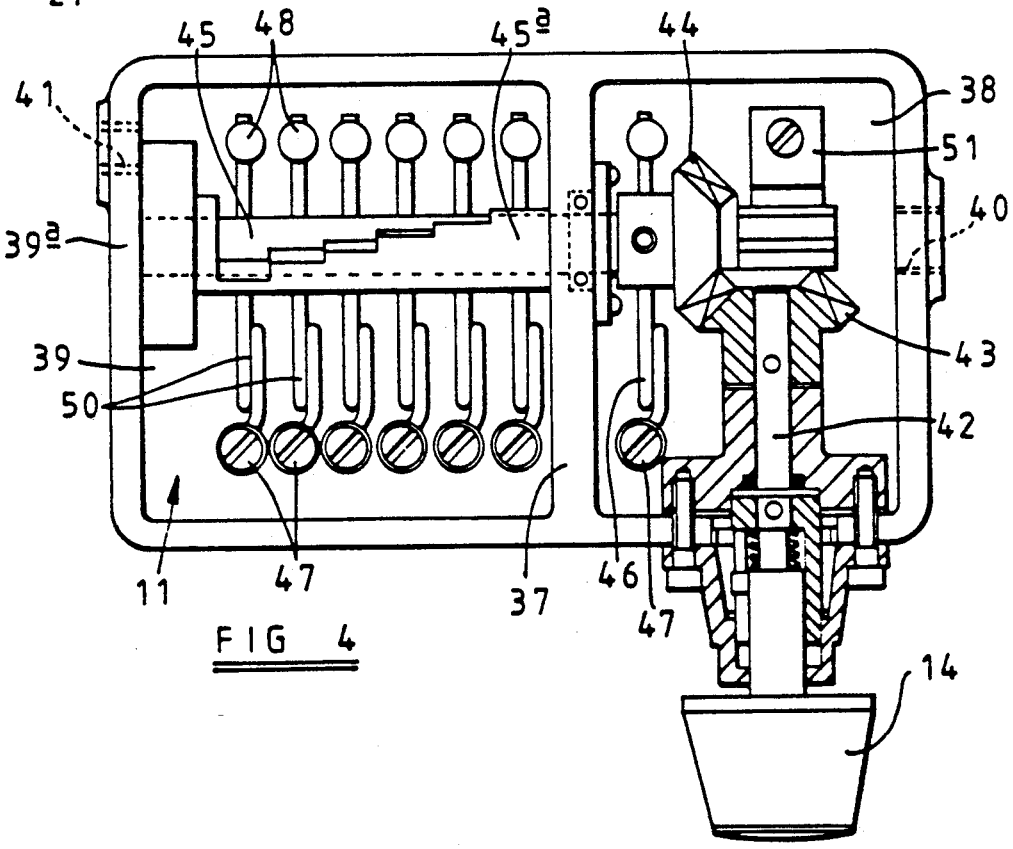
Figure 5:
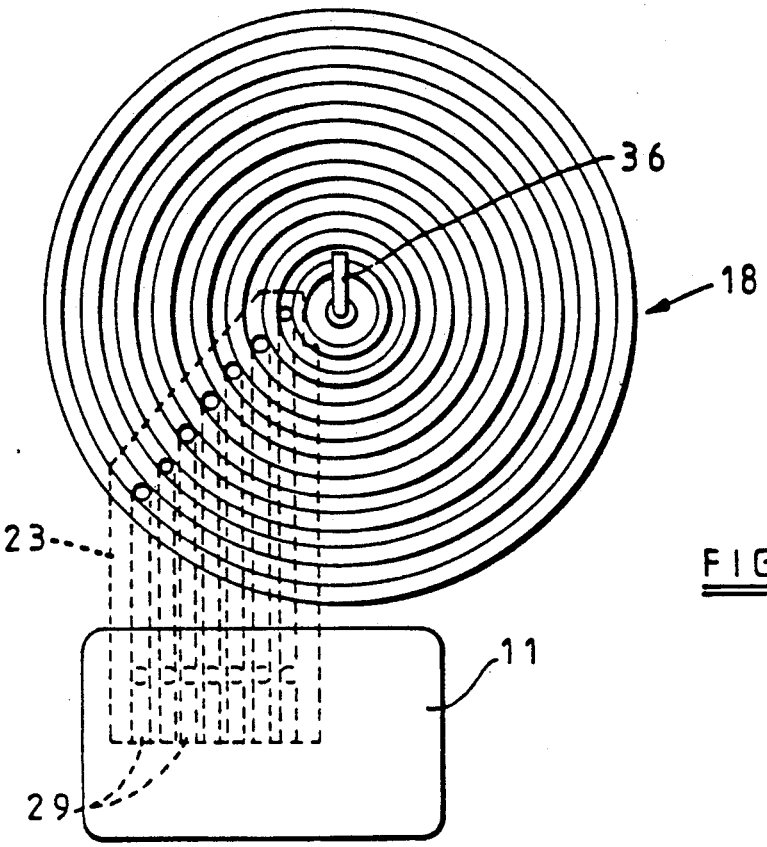
Figure 6:
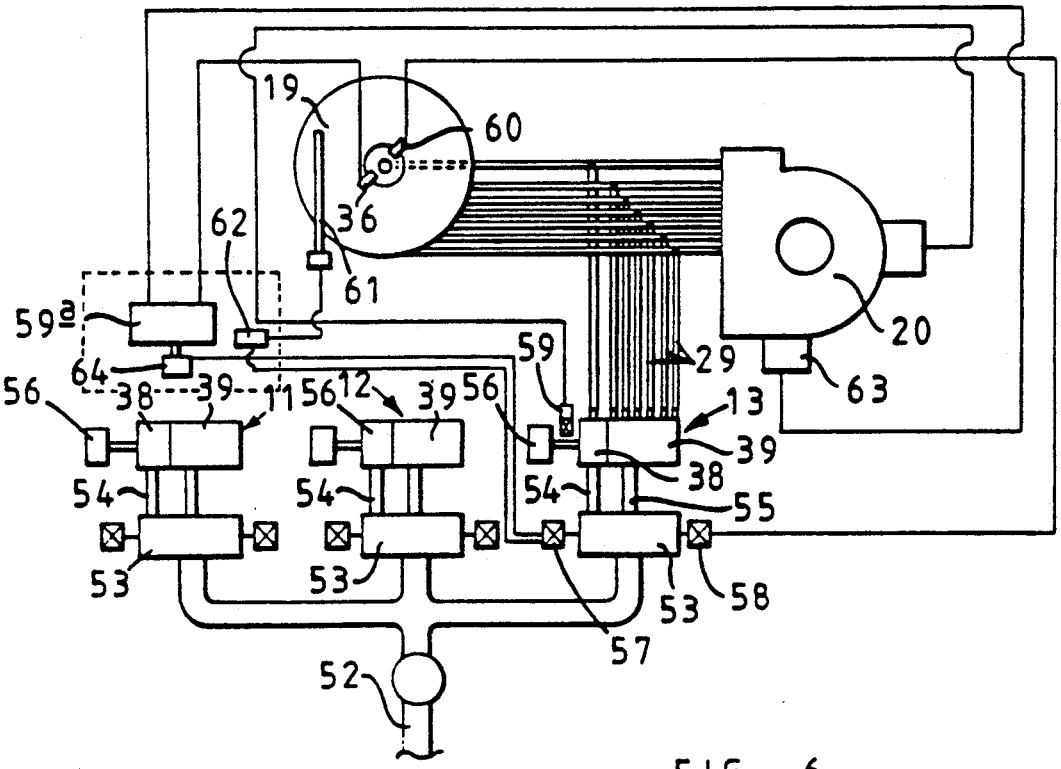

The invention will now be described, by way of example, with reference to the accompanying drawings, in which:

FIG. 1 is a schematic top plan view of a gas heated ceramic hob of the invention, with a top glass ceramic plate removed, FIG. 2 is an enlarged, fragmentary schematic view on a section through the hob of FIG. 1, FIG. 3 is a similar view to FIG. 2, but showing detail of a gas flow passage to a burner unit, and the burner unit itself, with the gas flow passage receiving gas from a control valve, FIG. 4 is an enlarged internal top view of a fluid flow control valve, FIG. 5 is an enlarged, top view of one of the burner units, with associated control valve and gas flow passages, of the hob of FIG. 1, and FIG. 6 is a diagrammatic view of an ignition system, a flame failure system and an overheat system of the hob of the invention.

A hob unit of the invention, which is shown schematically in FIG. 1, has a body 10 of generally rectangular configuration, there being at the one of its longer sides constituting a front 10*a* of the hob unit three gas flow control valves 11, 12, 13, with associated control knobs 14, 15, 16 respectively.

Within the body are a number of gas-fired heat radiating surface combustion burner units, in this example three, namely a small diameter burner unit 17 and two larger diameter burner units 18, 19 respectively. The burner units 18, 19 are arranged at the front of the gas hob adjacent the left and right sides thereof respectively, being controlled, as will be described, by the control valves 11 and 13 respectively. The burner unit 17 is positioned towards the rear of the gas hob and slightly to the left of the centre of the burner, being controlled by the control valve 12, which is disposed between valves 11, 13 along the front of the gas hob.

Disposed in the gas hob body below the level of the burner units is an electrically driven fan 20 of common type. The fan has its output volume controllable either by varying its speed or by varying its input or output orifice. The fan supplies air, in use, to a plenum chamber 21 which is in communication with respective sets 22, 23, 24 of burner unit gas/air supply ducts for supplying the burner units 17, 18, 19.

As best shown in FIGS. 2 and 3, the hob body 10 has its top closed by a glass ceramic plate 25, the burner units and the control valves (only one of each shown) being disposed below the plate 25 on a supporting surface 26. The burner units are all received closely below the plate 25, e.g. 10–20 mm. A vertical wall 27 separates the control valves from their respective associated burner units. The hob has means at its rear for removal of gaseous combustion products.

The fan 20 is disposed between the surface 26 and a base surface 28 of the hob body and the sets of supply ducts are at the same level as the fan. As shown in FIGS. 1 and 5, each set comprises four or seven parallel supply ducts in this example. At one end, each duct 29 has an orifice plate 30 carrying a plug 30*a* with an orifice therethrough to provide communication with the plenum chamber 21 which extends around each set of supply ducts. A short way inwardly from the plug, each duct has a gas nozzle 31 extending downwardly into it to supply gas to the duct from one of the control valves.

Each burner unit is made up of a lower plate 32 formed with a number of concentric chambers 33, for example seven chambers for the larger burner units. Fitted on top of the plate 32, via a gasket 34, is a ceramic radiant heat emitting burner plaque or plate 35 which is perforated to match the arrangement of the chambers to provide a number of concentric gas burning rings at its top surface closely below the glass ceramic plate 25. Burner plaques of this form are disclosed in West German Auslegeschrift no. 1116615, to which reference may be made. A spark electrode 36 is brought up through a centre hole in the plates 32 and 35, so as to be able to ignite the inner burner ring as a pilot light.

The other ends of the ducts in each set are upwardly open to communicate with the concentric chambers 33 respectively. Supply of gas to the sets of ducts is governed by the control valves, as will now be described.

FIG. 4 shows in detail the control valve 11 of the control valves 11, 12, 13 shown in FIGS. 1 to 3. The valve has a die cast metal body with a separate die cast metal cover (not shown) which is screwed to the body, with a gasket therebetween for a gas tight seal. A gas enclosure is thus formed within the valve.

The body is divided by a wall 37 into a pilot gas chamber 38 and a larger main gas chamber 39. The two chambers 38, 39 have respective gas inlets 40, 41 through the valve body. At the exterior of the wall of the valve body normal to the inlet 40, there is fitted the control knob 14 which can be of conventional form. At the inner end of a spindle 42 rotatable with the knob is a bevel gear 43 in mesh with a further bevel gear 44 on an end of a cam shaft part carried on a cam shaft centre spindle 45 journalled at and extending through a gas seal at the wall 37. The other end of the cam shaft spindle 45 is journalled at an end wall 39*a* of the chamber 39 through which extends the inlet 41.

In the bottom of the chamber 38 is an outlet in the form of a gas nozzle 31 previously described. A kinked spring wire 46 is secured at its one end to the bottom of the chamber 38 by a screw 47, passes beneath the cam shaft, and carries at its other, free end a closure element 48 having an outer butyl rubber pad 49 for engaging a seat of the gas nozzle 31 to close the outlet provided thereby. Similarly in the chamber 39, a plurality of further spring wires 50 and associated gas outlet nozzles are provided, the actual number corresponding to the number of gas rings in the associated burner unit, less the inner pilot ring. Accordingly, as shown in FIG. 4 there are six kinked spring wires 50 in chamber 39. The normal bias of each spring wire is to raise the closure element 48 and pad 49 of the nozzle seat, allowing gas flow therethrough.

As stated, the spindle 45 carries a cam shaft part in chamber 38 for rotation therewith. In chamber 39 the spindle 45 carries a cam shaft 45*a* for rotation therewith. The cam shaft part and the cam shaft 45*a* are each of hollow tubular form. The cam shaft 45*a* has its one end adjacent wall 39*a* closed around its 360° periphery. However, along its length in a direction away from its said one end, the tube has a series of adjacent part-annular cut outs extending through its thickness. The cam shaft part also has such a cut out. All the cutouts terminate at the same angular position around the cam shaft and cam shaft part (which can be considered a continuation of the cam shaft), but they start at regularly angularly staggered positions along the cam shaft, these positions being 30° of cam shaft rotation apart, so that the respective angles subtended between the two sides of the cut out at the axis of the cam shaft increase regularly by 30° along its length. Accordingly as the spindle 45, and thus the cam shaft 45*a*, rotates from a control knob 'OFF' position, where the spring wires in the two chambers are all forced by the cam shaft to seat the pads on the nozzle seats, each spring wire in turn is allowed to rise under its natural resiliency to open the nozzle outlet, the respective kinks in the spring wires being received in the then aligned cut-outs. The knob is numbered or otherwise marked to correspond to the number of outlets opened as it is rotated. A detent spring 51 engages an end of the cam shaft projecting into the pilot chamber 38 beyond the gear 44, so that the position of the shaft at which each spring wire is raised can be deduced, and also to tend to stop the cam shaft rotating so that an intermediate position between open and closed at a gas nozzle is not possible.

The nozzles 31 lead to the supply ducts already described and thus by rotating the control knob of a control valve the flow of gas to the ducts and thus the number of gas rings in operation at a burner unit can be varied. The first 'ON' position of the knob is where gas is supplied to the duct leading to the innermost ring which, when lit, acts as a pilot light for lighting the other rings in turn if the knob is then turned to its fully 'ON' position. If the knob is rotated in the opposite direction from its fully 'ON' position the rings are turned off in sequence, down to, but normally not including, the pilot ring. FIGS. 2 and 3 schematically show a spring wire in 'OFF' and 'ON' positions respectively of the control knob. Alternatively provision could be made for overriding the sequence of supplying gas outwardly from the innermost ring and switching rings off towards the innermost ring.

FIG. 6 will now be referred to in order to explain various other controls of the gas hob. The figure diagrammatically shows the fan 20 with its central motor, a main gas supply pipe 52 with three branches, each branch leading to a flame failure device 53, which is conveniently a double beat type of valve. Gas outlets 54, 55 are shown from the devices 53 to the chambers 38, 39 respectively of a control valve 11, 12 or 13. In an actual hob however, the flame failure device would probably be secured to the side wall of the control valve having the inlets 40, 41 arranged so that the outlets from the device 53 would merely be outlets in its side wall communicating directly with the inlets 40, 41. Each control valve has a spring loaded push button 56 at its pilot chamber end, although in FIG. 6 the full controls are shown only for control valve 13. This button is, in this embodiment, the control knob 14, 15 or 16 itself. Valves 11 and 12 have identical controls to those to be described for valve 13, but are not shown for clarity.

Shown for valve 13 is its associated burner unit 19 and, schematically, the seven supply ducts 29 from the valve to the burner unit. Schematically shown also are seven air supply ducts for air from the fan. The flame failure device 53 has at one end a thruster solenoid 57 controlling gas flow to the pilot chamber 38 and at its other end a second solenoid 58 controlling total gas flow. In the path of operation of the knob/push button 14/56 is trip means 59 of an ignition system **59*a* for all the burner units pilots. Flame detection means 60, e.g. a thermocouple, at the pilot gas ring of unit 19 is connected to the solenoid 58. An overheat device, in the form of a thermostat 61 is arranged over or adjacent the burner unit towards the outer gas rings, and in contact with the lower surface of plate 25. The thermostat is connected via an electric control 62 to the solenoid 57. The fan is also connected to the ignition system, via a fan pressure switch 63, to ensure that it is switched on at all times when any one burner unit is in operation. FIG. 6 also shows an electronic timing device 64 of system 59*a* connected to solenoid 57 and, via system 59*a*, to switch 63**.

Operation of the burner unit 19 will now be described, assuming flow of gas only to the flame failure device 53 initially.

Firstly, to light the innermost pilot ring of burner unit 19, the push button/control knob 14 (FIG. 4) is pushed in and turned to the position corresponding to the number of rings required in use. The pushing in of knob 14, which is equivalent to pushing in button 56, actuates trip means 59 which causes the fan motor to be energised, air movement from the fan 20 causing the switch 63 to operate. Such operation activates the ignition system **59*a*, producing a spark at electrode 36 at the centre of the burner, simultaneously operating solenoid 57 of device 53. With the double beat type valve mentioned, operation of the solenoid forces a closure member onto an opening to prevent gas flow between pipe 52 and outlet 55, and forces an armature off an opening between pipe 52 and outlet 54, to allow gas to flow to the pilot chamber 38 of control valve 13. Since the knob 14 has been rotated by at least an amount sufficient to allow lifting of closure element 48 in chamber 38, gas flows from chamber 38 along the longest of the ducts 29**, mixing with air, to the innermost burner unit ring, where it ignites.

Simultaneously with the ignition sequence described above, the fan pressure switch 63 also starts the timing device 64 which is set, for example for 10 seconds, so that after the thermocouple 60 is sufficiently heated by the pilot to maintain the valve armature against solenoid 58, the device 64 cuts off the electrical supply to solenoid 57, causing the closure member to move off the opening between pipe 52 and outlet 55, thereby now allowing gas to flow to chamber 39 as well as chamber 38. Once the flame is established on the pilot ring, the spark generator senses this, suppressing the spark in the normal way.

Thus with the pilot lit, the knob 56 can be turned to switch as many of the remaining burner rings as are required into, or subsequently out of, use, the gas/air mixture at each ring being lit by the pilot. As explained, rotation of the knob opens the nozzles 31 in turn to supply gas to the ducts 29 where it mixes with the air introduced by the fan. The gas/air mixture burns to provide an intensive heat radiation.

If the burner unit heat output, as measured for example at plate 25, exceeds a predetermined value, this is sensed by the thermostat 61 which operates the control 62 to reactivate (energise) the solenoid 57 and thus extinguish the burner rings except the pilot ring, by cutting off gas flow to the gas outlet 55. When the heat output drops sufficiently the process requries and the rings operate again.

If all the gas flames were to be extinguished with gas still being supplied, the flame failure device (thermocouple) would sense this and operate by deactivating solenoid 58 and thus prevent gas flowing out of the device 53 through outlets 54, 55.

The advantages to be gained by way of the invention when compared to previous gas heated ceramic glass hobs are as follows.

By using a multiplicity of burner chambers at each of the several burner stations which usually comprise the hob unit, and by separately controlling these chambers ON or OFF, then a wide range of control may be achieved without significant detriment to the thermal efficiency of heat transfer common in all current designs of gas ceramic hob. There is no necessity to resort to the ON/OFF cycling control which is grossly inefficient since the burners seldom, if ever, reach their maximum effective temperature.

A round domestic burner 200 mm in diameter with seven annular chambers has been found to allow more than adequate control for the largest pans commonly used domestically and when rated at 3 Kw is capable of heating 2 pints (1.137 liters) of water to 100° C. from 20° C. in less than 7 minutes. At its 2 kw setting, independent tests to British Standard 5386 Part 3 (European Standard EN 30), have resulted in efficiencies in excess of 49% being achieved.

By using an electrically powered fan to deliver combustion air to each of the chambers and by mixing the gas with the air in the ducts leading to the burner chambers whilst controlling this separately, many of the disadvantages inherent in a gas heated ceramic hob have been overcome. In particular, since the ratio of air was in the mixture can be closely controlled, the radiant heat burner can be operated at aeration levels (typically 100–110% stoichiometric) at which its radiant efficiency is at maximum. Such levels would be impractical, if not impossible, to obtain in a similar atmospheric aspirated burner.

The small size of the ducts leading to the burner chambers also enables a 'thinner' unit to be achieved, allowing a low level grill to be used if required or cupboard space below the hob to be fully utilized.

Due to the excellent mixing of air and gas possible with this method, much higher gas input rates can be achieved whilst still maintaining good combustion performance. An increase from 3 Kw with normally aspirated burners to 4 Kw with a seven ring 200 mm diameter burner using a fan has been found to be possible.

The clearance of products of combustion is improved since no reliance need be placed on thermal lift and the more rapid clearance enables the gap between burner and top plate to be reduced, increasing radiant transfer efficiency. Conduction heat transfer is also improved due to the added turbulence of the flow. By maintaining the air supply to all burner chambers even when the gas supply is cut off, a beneficial cooling effect can be achieved greatly improving the controllability.

As the heat input can be increased, the burner can be made to heat up much more quickly. As both heating and cooling are therefore quicker, the controllability is improved.

The surface temperature of the radiant burner is such that the glow can be easily seen through any glass ceramic hob and the heat input can be judged by the number of rings seen. The number of rings burning can be easily adjusted to suit the diameters of the pans in use. The described safety device guards against overheating of the glass and thus maintains efficiency.

Since all air necessary for combustion is provided by the fan, no allowance for secondary air is necessary so that there is no constraint on burner size used or any necessity to feed secondary air centrally through any burner. Burners to suit very large pans, as for instance used in commercial catering, can be made.

Many variations from the example of the invention described and illustrated are possible, and some of these will be listed hereunder.

Instead of a single glass ceramic plate 25, separate such plates individual to each burner unit can be used together in multiples to form a multiple burner hob unit. Instead of a single ceramic plate 35, the top of the burner unit could be made up of two or more separate sections which fit together to provide a suitably perforated ceramic burner plaque matching the pattern of the chambers.

As described, at one end of each set of supply ducts 29 is an orifice plate. This can provide for entry of air to each duct merely by having orifices therethrough or it can receive plugs with respective orifices through them, as described and illustrated. The volume of air supplied to each duct is, with either arrangement, determined by the size of the orifice. This is dependent on the type of gas in use and is predetermined for each duct and thus allows simple conversion from one fuel gas type to another, i.e. natural gas to L.P.G.

The overheat device can be arranged to cut off only some of the rings, rather than all but the pilot ring, at a predetermined ceramic glass temperature.

The fan can have multiple outlets to feed combustion air to some or all of the burner units simultaneously, rather than the single outlet and single plenum chamber described. A further alternative is a branched conduit conveying air to the burners from a single outlet of the fan. The fan, or a second fan, could be used to draw out the gaseous products of combustion. Alternatively, a fan could be used to draw combustion air through the hob, pre-mixing it with gas before it reaches the supply ducts. Moreover, in a closed top hob as described, the or each of the fans can be used both to supply air for combustion and to remove the products of combustion. In a further variation, the or each fan or combination of fans has sufficient capacity to allow air to be bled from the combustion system for secondary uses, such as diluting the hot flue gasses, cooling the glass top rapidly after use, or reducing the temperature of the ducts and/or the burner control units.

The fan may be capable of operating at two or more fixed speeds. The fan may be arranged to continue to operate after the burner units are extinguished, under either manual or automatic control, so as to continue to carry out its secondary functions, for example using the heat built up during the cooking process to maintain the temperature of a warming drawer or cupboard. A fan can be used to facilitate the flow of gases through the hob.

The overheat device could be a thermocouple or a flame rectification electrode to engage the flames issuing from the smallest burner ring.

The overheat device could be a thermocouple or a flame rectification electrode to engage the flames issuing from the smallest burner ring.

With a gas cooker incorporating a hob as described, the control knobs 14, 15 and 16 would project from the front of the cooker as in FIG. 1. However, if the hob were to be arranged as a separate item at a worktop, the knobs 14, 15, 16 would be arranged to be vertical through similar right-angled gearing as that shown in FIG. 4, but with the knob axis turned upright by 90°. It is considered that the gearing between the knobs and associated respective cam shafts may advantageously be other than 1:1.

The supply ducts 29 could be formed by machined channels in a material block, as suggested in FIG. 3. However to reduce costs and ease manufacture the ducts could be provided by extruding each set 22, 23, 24 with the ducts automatically thereby formed therein, or by merely having a plate bent to provide seven upwardly open channels which are closed by wall 26. Instead of an orifice plate at the front of each of whichever form of set 22, 23, 24 used, each duct could merely have a plug 30*a*, as suggested in FIG. 3.

I claim:

1. A gas hob comprising a glass ceramic top plate, at least one gas-fired heat radiating burner unit arranged closely below said top plate, the or each unit having a multiplicity of chambers over which is disposed a ceramic burner plate perforated to match the pattern of said chambers, the chambers of each burner unit being in communication with respective associated air supply passages, an inlet to each passage having an orifice of a predetermined size to govern the amount of air entering the passage, in use, gas supply means to each air supply passage, fan means arranged to supply air through said air supply passage inlets to all the chambers of a burner unit at all times when gas is supplied to at least one chamber of said burner unit, supplied gas and air mixing prior to entering one or more of said chambers and thereafter one or more of said burner plate perforations, and means for independently controlling the supply of gas to each air supply passage.

2. A gas hob as claimed in claim 1, wherein the orifices for the passages are provided by an orifice plate extending across the respective passage inlets.

3. A gas hob as claimed in claim 1, wherein the fan means is a single fan which delivers air, in use, to a plenum chamber with which the or each air supply passage is in communication.

4. A gas hob as claimed in claim 1, wherein the fan means is a single fan having multiple outlets to deliver air, in use, to a plurality of burner units respectively.

5. A gas hob as claimed in claim 1, wherein the fan means is capable of operating at two or more fixed speeds.

6. A gas hob as claimed in claim 1, wherein said means for independently controlling the supply of gas includes a control valve manually operable by a control knob, angular movement of which causes angular movement of a cam shaft thereby to compress or release a multiplicity of spring wires which control gas flow to said air supply passages.

7. A gas hob as claimed in claim 6, wherein each spring wire has a closure element at one of its ends for seating against and closing a gas nozzle, the spring wires initially, in a off position of the control knob, themselves biasing the closure elements to seat against the gas nozzles respectively or being forced to do so by the cam shaft, angular movement of the control knob allowing the spring wires themselves to move the closure elements off their seats respectively or causing the cam shaft to effect such spring wires and closure elements movement, to open the nozzles in a predetermined sequence to allow gas flow to the chambers of the burner unit associated with said control valve as the control knob is angularly moved.

8. A gas hob as claimed in claim 6, wherein the cam shaft of each control valve is arranged to allow gas to be admitted to the burner unit chambers only in a predetermined sequence, and to cut off the supply of gas in the reverse sequence.

9. A gas hob as claimed in claim 7, wherein each control valve is divided into two gas tight chambers each having a gas inlet opening, one chamber containing a single spring wire and associated gas nozzle for controlling gas supply to one burner plate perforation constituting, in use, a pilot light for the hob, the other chamber containing the remaining spring wires and associated gas nozzles for bringing the remaining burner plate perforations into operation, a single cam shaft extending into both chambers of the control valve and being operable by the control knob.

10. A gas hob as claimed in claim 1, having provision for automatically cutting off some or all of the burner plate perforations at a predetermined top plate temperature.

11. A gas hob as claimed in claim 1, wherein each burner unit has an igniter electrode protruding through its centre.

12. A hob as claimed in claim 1, wherein each burner unit has a flame failure device, including a detector at the centre of the burner unit.

13. A hob as claimed in claim 12, wherein the detector is arranged to operate a solenoid at the flame failure device which prevents gas passing out of the device to the burner unit at which the flame detection device is positioned if no flame is detected, and allows gas to pass when flame is detected.

14. A hob as claimed in claim 13, wherein the flame failure device has a further solenoid thereat which is operated by a thermostat to control the supply of gas to said air supply passages by cutting off the supply of gas to all except the one of said air passages feeding a pilot section of said ceramic burner plate during non-flame failure conditions, at a predetermined glass ceramic top plate temperature sensed by the thermostat.

15. A hob as claimed in claim 6, wherein the control knob and the cam shaft of the control valve are interconnected at an angle to each other.

* * * * *